US010386074B2

(12) United States Patent
Arellano et al.

(10) Patent No.: US 10,386,074 B2
(45) Date of Patent: Aug. 20, 2019

(54) INJECTOR HEAD WITH A RESONATOR FOR A GAS TURBINE ENGINE

(71) Applicant: Solar Turbines Incorporated, San Diego, CA (US)

(72) Inventors: Leonel Arellano, Poway, CA (US); James Wilfrid Blust, II, San Diego, CA (US); Ariel Schuger, La Mesa, CA (US); Ashley Vega, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 381 days.

(21) Appl. No.: 15/374,237

(22) Filed: Dec. 9, 2016

(65) Prior Publication Data

US 2018/0163967 A1 Jun. 14, 2018

(51) Int. Cl.

| | |
|---|---|
| ***F23R 3/14*** | (2006.01) |
| ***F23R 3/28*** | (2006.01) |
| ***F23R 3/46*** | (2006.01) |

(52) U.S. Cl.

CPC ..... *F23R 3/286* (2013.01); *F23R 3/14* (2013.01); *F23R 3/46* (2013.01); *F23R 2900/00014* (2013.01)

(58) Field of Classification Search

CPC .. F23R 3/286; F23R 3/14; F23R 2900/00014; F23R 3/283; F23R 3/343; F23R 2900/03343; F05D 2260/96; F05D 2260/963; F23D 2210/00

See application file for complete search history.

(56) References Cited

U.S. PATENT DOCUMENTS

| | | | | |
|---|---|---|---|---|
| 5,404,711 | A * | 4/1995 | Rajput | F23D 14/02 239/400 |
| 7,464,552 | B2 | 12/2008 | Sattinger | |
| 7,827,781 | B2 * | 11/2010 | Bendel | F02K 9/52 60/257 |
| 8,127,546 | B2 * | 3/2012 | Park | F23R 3/28 181/213 |
| 8,474,265 | B2 | 7/2013 | Jain et al. | |
| 8,789,372 | B2 | 7/2014 | Johnson et al. | |
| 8,869,533 | B2 | 10/2014 | Bulat | |
| 9,212,823 | B2 | 12/2015 | Boardman et al. | |
| 9,341,375 | B2 | 5/2016 | Kim et al. | |
| 2005/0106519 | A1 * | 5/2005 | Flohr | F23R 3/14 431/114 |

(Continued)

FOREIGN PATENT DOCUMENTS

EP 2851618 A1 3/2015

*Primary Examiner* — Todd E Manahan
*Assistant Examiner* — Todd N Jordan
(74) *Attorney, Agent, or Firm* — Procopio, Cory, Hargreaves & Savitch LLP

(57) ABSTRACT

A fuel injector for a combustor of a gas turbine engine is disclosed herein. In embodiments, the fuel injector includes an injector head adjoining a stem. The injector head includes a main premix passage, a main air inlet, vanes, and a main premix resonator. The main premix passage extends through the injector head and the main air inlet directs compressed air into the main premix passage. The vanes are located within the main premix passage for swirling the compressed air. The main premix resonator is located adjacent to and downstream of the vanes.

17 Claims, 5 Drawing Sheets

(56) References Cited

U.S. PATENT DOCUMENTS

| | | | | |
|---|---|---|---|---|
| 2012/0204534 | A1 | 8/2012 | Kenyon | |
| 2012/0324896 | A1* | 12/2012 | Kim | F23C 7/004 60/737 |
| 2016/0076766 | A1 | 3/2016 | Jayatunga | |
| 2016/0177836 | A1* | 6/2016 | Wickstrom | F23R 3/28 60/772 |
| 2016/0186662 | A1* | 6/2016 | Stewart | F23R 3/14 239/403 |
| 2017/0254541 | A1* | 9/2017 | Bottcher | F23R 3/20 |
| 2017/0356656 | A1* | 12/2017 | Ogata | F23R 3/28 |
| 2018/0066847 | A1* | 3/2018 | Stoia | F02C 3/04 |

* cited by examiner

INJECTOR HEAD WITH A RESONATOR FOR A GAS TURBINE ENGINE

TECHNICAL FIELD

The present disclosure generally pertains to an injector head, and is directed toward an injector head of a gas turbine engine with integral resonators.

BACKGROUND

Gas turbine engines include compressor, combustor, and turbine sections. During operation of the gas turbine engine combustion oscillations may damage or reduce the operating life of the components of the combustor. Combustion oscillations may be the result of resonance of the fuel and/or air within the injector heads of the fuel injectors.

U.S. Pat. No. 8,789,372 to Johnson, et al. discloses a system that may include a turbine engine. The turbine engine may include a fuel nozzle. The fuel nozzle may include an air path. The fuel nozzle may also include a fuel path such that the fuel nozzle is in communication with a combustion zone of the turbine engine. Furthermore, the fuel nozzle may include a resonator. The resonator may be disposed in the fuel nozzle directly adjacent to the combustion zone.

The present disclosure is directed toward overcoming one or more of the problems discovered by the inventors or that is known in the art.

SUMMARY OF THE DISCLOSURE

A fuel injector for a combustor of a gas turbine engine is disclosed. In one aspect of the invention, the fuel injector includes a stem, a fitting joined to the stem, a main stem fuel passage, and an injector head. The main stem fuel passage extends within the stem and fluidly connects to the fitting. The main stem fuel passage includes a main stem passage outlet. The injector head adjoins the stem distal to the fitting and adjacent to the main stem passage outlet. The injector head includes a feed air inlet, a main premix passage, a main air inlet for the main premix passage, vanes, and a main premix resonator. The feed air inlet allows compressed air to enter the injector head. The main premix passage extends through the injector head. The main air inlet is located adjacent to the feed air inlet. The vanes are located within main premix passage for swirling the compressed air that enters the main premix passage through the main air inlet. The main premix resonator is located adjacent to and downstream of the vanes, or upstream of the vanes.

In another aspect of the invention, the fuel injector includes a stem, a fitting joined to the stem, a pilot stem fuel passage, and an injector head. The pilot fuel stem passage extends within the stem and fluidly connects to the fitting. The pilot stem fuel passage includes a pilot stem passage outlet. The injector head adjoins the stem distal to the fitting. The injector head includes a feed air inlet, a pilot premix passage, a pilot fuel inlet, and a pilot fuel resonator. The feed air inlet allows compressed air to enter the injector head. The pilot premix passage provides a fuel and air mixture to the combustion chamber. The pilot fuel inlet provides the fuel to the pilot premix passage. Resonators are adjacent to the pilot fuel inlet, the pilot premix passage and the pilot air passage.

DETAILED DESCRIPTION

The systems and methods disclosed herein include an injector head with integral resonators. In embodiments, the injector head includes fluid passages, such as fuel passages, air passages, and mixture passages. The resonators may be positioned adjacent to transition orifices including inlets or outlets of the fluid passages that the fluids, such as fuel and air, pass through. The resonators may be radially located relative to the passage, such as a Helmholtz resonator, or may be an in-line resonator, such as a resonating cavity or a circuitous labyrinth that is in-line with the fluid passage. The radially located resonators may include a resonating cavity and a neck connecting the cavity to the fluid passage adjacent to a transition orifice. Locating the resonators adjacent to the transition orifices may minimize the resonance of the fluids within the injector head, which may reduce combustor oscillations and increase the operating life of the components in the combustor.

Figure 1:
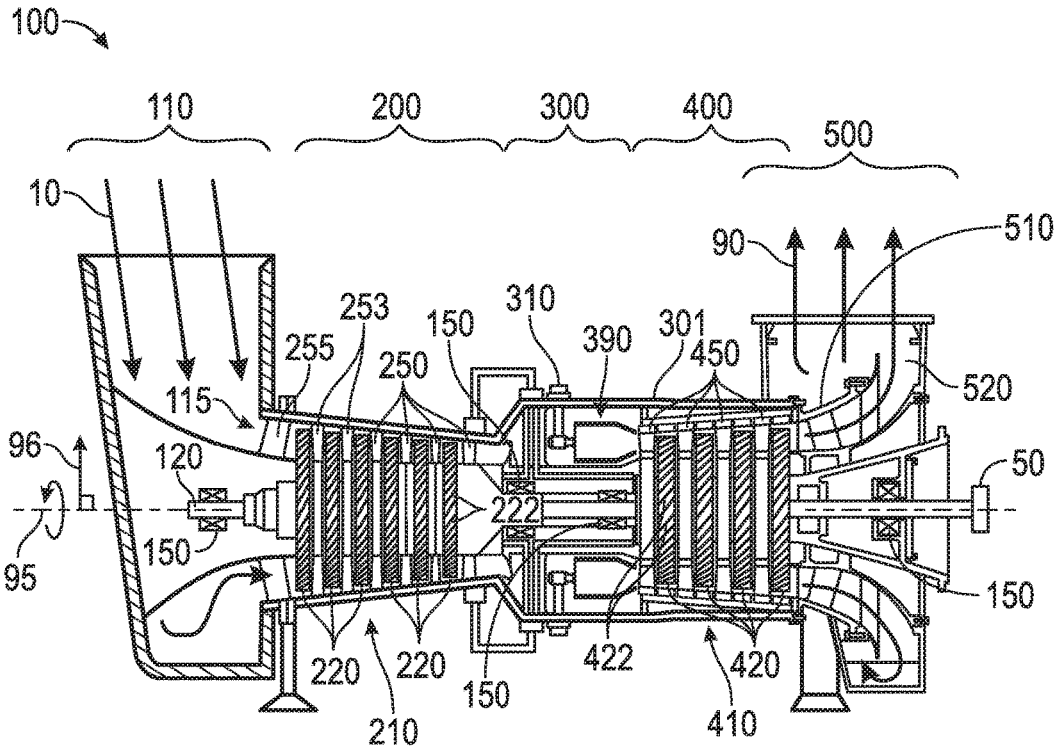
FIG. 1 is a schematic illustration of an exemplary gas turbine engine.

FIG. 1 is a schematic illustration of an exemplary gas turbine engine 100. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an inlet 110, a shaft 120, a compressor 200, a combustor 300, a turbine 400, an exhaust 500, and a power output coupling 50. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages.

The combustor 300 includes a combustion chamber 390 and one or more fuel injectors 310. The fuel injectors 310 may be upstream of the combustion chamber 390 and may be annularly arranged about center axis 95.

The turbine 400 includes a turbine rotor assembly 410 and turbine nozzles 450. The turbine rotor assembly 410 mechanically couples to the shaft 120. In the embodiment illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 510 and an exhaust collector 520. The power output coupling 50 may be located at an end of shaft 120.

Figure 2:
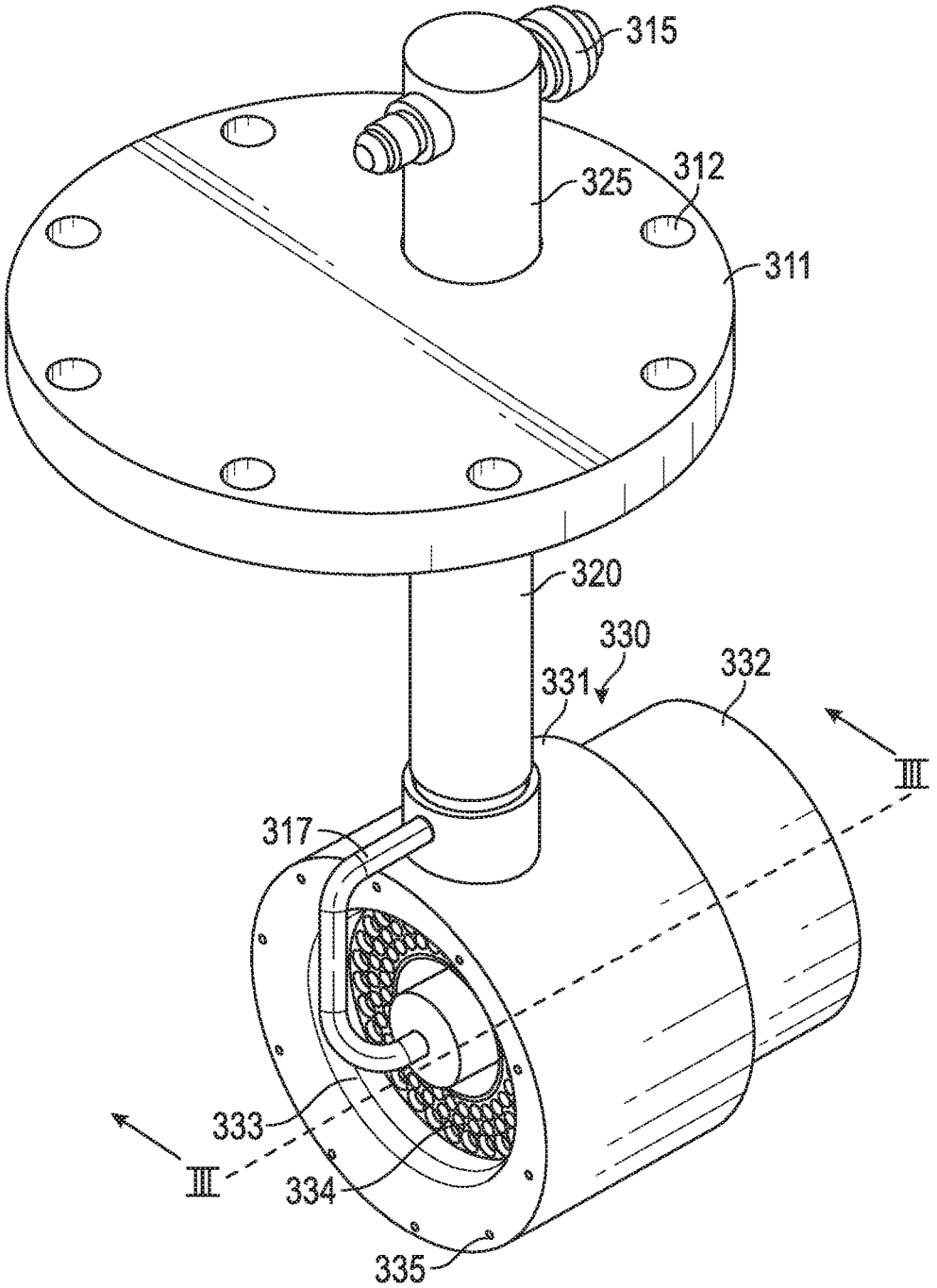
FIG. 2 is a perspective view of an embodiment of the fuel injector.

FIG. 2 is a perspective view of an embodiment of the fuel injector 310. The fuel injector 310 may include an injector head 330, a stem 320, fittings 315, and a flange 311. The injector head 330 supplies fuel to the combustion chamber 390 for combustion. The stem 320 may extend from the injector head 330 and supply fuel to the injector head 330. In embodiments, the injector head 330 may adjoin the stem 320 distal to the fittings 315.

The fittings 315 supply fuel to the fuel injector 310 from a fuel source. The fuel may be a liquid or a gaseous fuel. The flange 311 may be joined to the stem 320, such as by metallurgical bonding. The flange 311 may include mounting holes 312 for securing the fuel injector 310 to the gas turbine engine 100.

Figure 3:
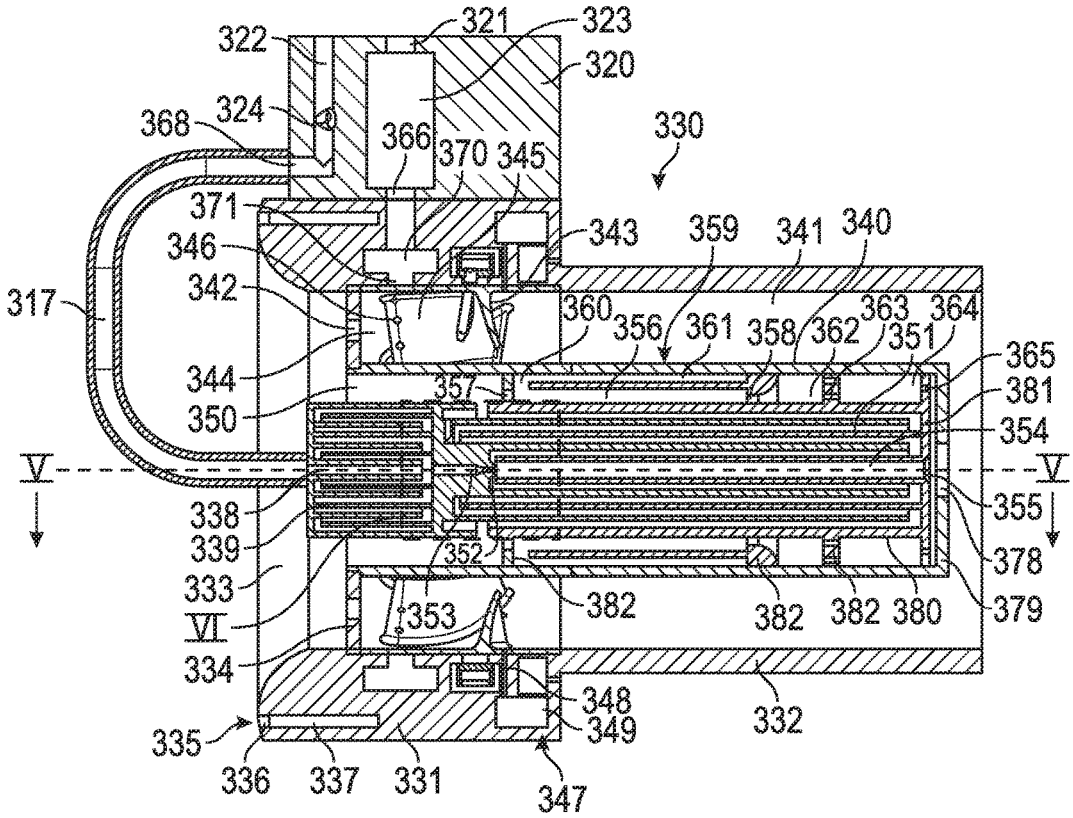
FIG. 3 is a cross-sectional view of an embodiment of the injector head of FIG. 2 taken along line III-III shown in FIG. 2.
Figure 4:
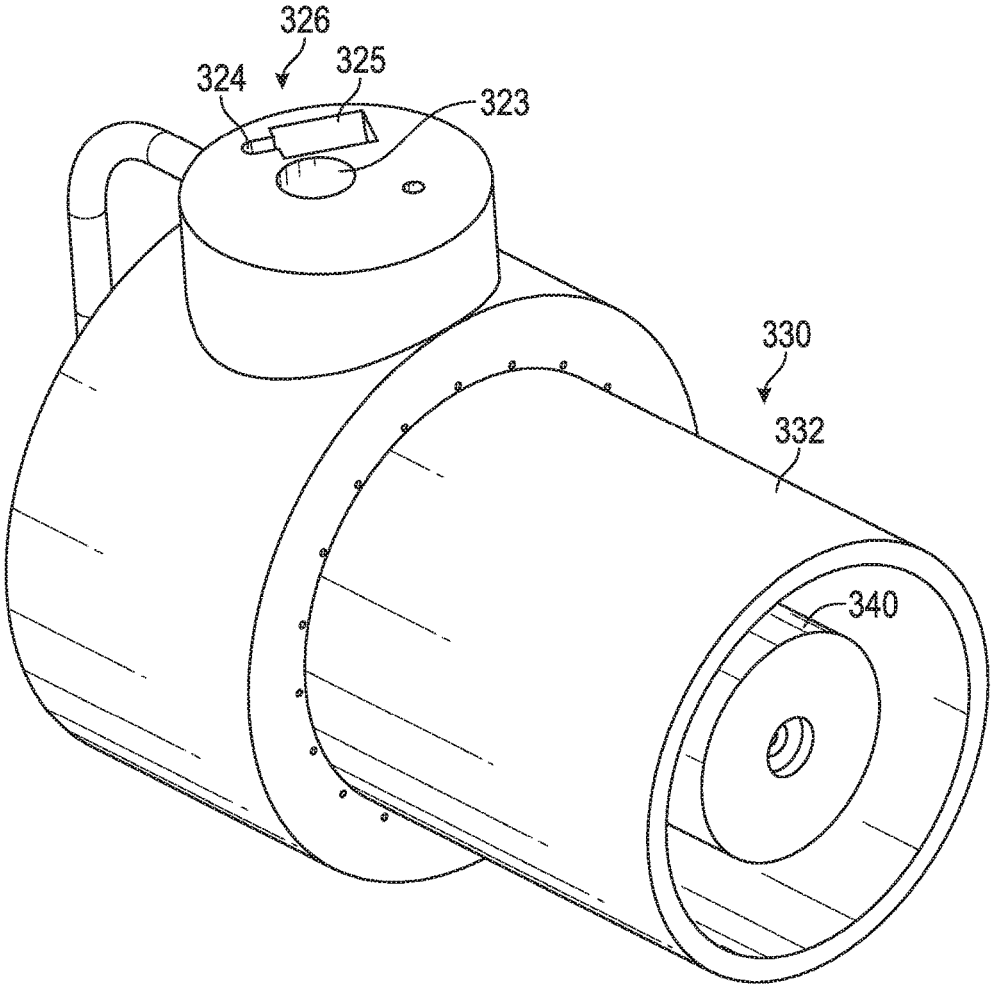
FIG. 4 is a perspective view of the injector head of FIG. 2 with a portion of the stem cut away.

FIG. 3 is a cross-sectional view of an embodiment of the injector head 330 of FIG. 2 taken along line III-III shown in FIG. 2. FIG. 4 is a perspective view of the injector head of FIG. 2 with a portion of the stem cut away. Referring to FIGS. 3 and 4, the stem 320 may include a main fuel stem passage 321, a pilot fuel stem passage 322, a main fuel stem resonator 323, and a pilot fuel stem resonator 326. The main fuel stem passage 321 and the pilot fuel stem passage 322 may extend through the stem 320 from the fittings 315 shown in FIG. 2 to or adjacent to the injector head 330. The main fuel stem passage 321 and the pilot fuel stem passage 322 are fluidly connected to the fittings 315. In the embodiment illustrated, the fuel injector 310 includes a pilot fuel tube that connects the pilot fuel stem passage 322 to the injector head 330. The main fuel stem passage 321 may include a main stem passage outlet 366 that directs the main fuel into the injector head 330 and the pilot fuel stem passage 322 may include a pilot stem passage outlet 368 that directs the pilot fuel to the injector head 330. In some embodiments, the pilot stem passage outlet 368 may direct the pilot fuel into a pilot fuel tubing 317 that directs the pilot fuel from the stem 320 to the injector head 330. The injector head 330 may adjoin the stem 320 adjacent to the main stem passage outlet 366 and the pilot stem passage outlet 368.

The main fuel stem resonator 323 and the pilot fuel stem resonator 326 may be adjacent to the injector head 330. The main fuel stem resonator 323 and the pilot fuel stem resonator 326 along with the other resonators described herein may each be radially located relative to the passage, such as a Helmholtz resonator, or may be an in-line resonator, such as a resonating cavity or a circuitous labyrinth that is in-line with the fluid passage. The radially located resonators may include a resonating cavity and a neck connecting the cavity to the fluid passage adjacent to a transition orifice, such as an inlet or an outlet for the fluid passage. In the embodiment illustrated, the main fuel stem resonator 323 is an in-line resonator located in the path of the main fuel stem passage 321 and is adjacent to the main stem passage outlet 366 as illustrated in FIG. 3; and the pilot fuel stem resonator 326 is a radial stem resonator and is adjacent to the pilot stem passage outlet 368 as illustrated in FIG. 4. In the embodiment illustrated, the pilot fuel stem resonator 326 includes a pilot fuel stem resonator cavity 325 formed in the stem 320 and a pilot fuel stem resonator neck 324 connecting the pilot fuel stem resonator cavity 325 to the pilot fuel stem passage 322.

Referring to FIG. 3, the injector head 330 may include an injector body 331, an injector barrel 332, an inner premix tube 340, vanes 345, and a pilot tube 380. The various passages and resonators of the injector head 330 may be formed within one or more of the injector body 331, the injector barrel 332 and the inner premix tube 340, between the injector body 331, the injector barrel 332 and the inner premix tube 340, or formed from a combination thereof.

The injector body 331 may have a hollow cylinder shape. The injector body 331 may be integral to the stem 320, such as unitary with the stem 320 or joined to the stem 320. The injector body 331 may be joined to the stem 320 by a metallurgical bond. The injector barrel 332 may have a hollow cylinder shape and may axially extend from the injector body 331. The inner premix tube 340 may have a cylindrical shape and may extend within the injector body 331 and the injector barrel 332.

The inner premix tube 340 may be located inward and offset from the injector body 331 and the injector barrel 332, which may form a main premix passage 341 or a portion of the main premix passage 341. The inner premix tube 340 may be coaxial to the injector body 331 and the injector barrel 332. The inner premix tube 340 may include an inner premix tube cap 379 that may act as a heat shield for the pilot fuel air mixture that may flow there within. The inner premix tube cap 379 may include a premix tube injection opening for the pilot fuel air mixture to pass through and enter into the combustion chamber 390.

The vanes 345 may extend between the injector body 331 and the inner premix tube 340 through the main premix passage 341. The vanes 345 may cause the main air and fuel passing there through to swirl and mix prior to combustion. The vanes 345 may join the injector body 331 to the inner premix tube 340.

The pilot tube 380 may be located inward from the inner premix tube 340 and may be extend within the injector body 331 and the injector barrel 332. The pilot tube 380 may include a cylinder shape and may include a pilot tube cap 381 that is adjacent to the inner premix tube cap 379. The pilot tube cap 381 may include a pilot tube injection opening 355 that may direct the pilot fuel air mixture into the combustion chamber 390.

The injector body 331, the injector barrel 332, the inner premix tube 340, the vanes 345, and the pilot tube 380 may be integral, such as unitary, joined together by metallurgical bonds, or combinations thereof.

Referring to FIGS. 2 and 3, the injector head 330 may also include a feed air inlet 333, feed air resonators 335, a main air inlet 334, and a secondary air inlet 350. The feed air inlet 333 may be located in the injector body 331 and may be opposite the injector barrel 332. The feed air inlet 333 may include a taper and may have a funnel shape, such as a bellmouth or a hyperbolic funnel shape. The feed air inlet 333 may be axially aligned with the hollow cylinder shape of the injector body 331. The feed air inlet 333 may allow compressed air to enter the injector head 330.

The feed air resonators 335 may be adjacent to the feed air inlet 333 and may be located outward from the feed air inlet 333. The feed air resonators may be radial resonators and may be Helmholtz resonators. Each feed air resonator 335 may include a feed air resonator cavity 337 and a feed air resonator neck 336. In the embodiment illustrated, the feed air resonator cavity 337 is a cylindrical cavity extending axially into the injector body 331 adjacent to the feed air inlet 333.

The main air inlet 334 may be an annular plate extending between the injector body 331 and the inner premix tube 340 adjacent to the feed air inlet 333. The main air inlet 334 may include main air inlet passages 342 that control the amount of air that enters the main premix passage 341. The secondary air inlet 350 may be located inward from the main air inlet 334 and may provide air for the pilot air and for cooling air.

Figure 5:
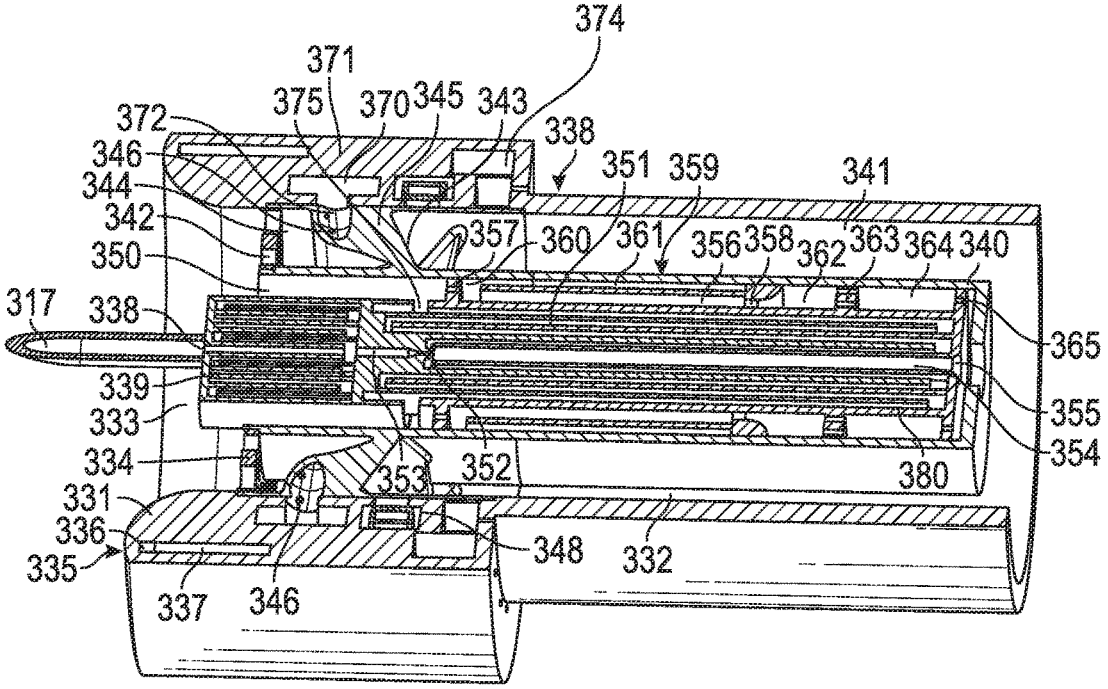
FIG. 5 is a cross-sectional view of the injector head of FIG. 2 taken along line V-V shown in FIG. 3.

FIG. 5 is a cross-sectional view of the injector head 330 of FIG. 2 taken along line V-V shown in FIG. 3. Referring to FIGS. 3 and 5, the injector head 330 may further include a main fuel gallery 370, main fuel vane resonators 372, a main fuel vane inlet passage 371 connecting each main fuel vane resonator 372 to the main fuel gallery 370, and main fuel mixing inlets 346. The main fuel gallery 370 may include an annular shape and may be located in the injector body 331. The main fuel gallery 370 may be located outward from and adjacent to the vanes 345. The main stem passage outlet 366 may provide fuel to the main fuel gallery 370. The main fuel mixing inlets 346 may direct the main fuel from the main fuel vane resonators 372 into the main premix passage 341.

Referring to FIG. 5, a main fuel vane resonator 372 may be formed in each vane 345. In the embodiment illustrated, each main fuel vane resonator 372 is an in-line resonator where the main fuel vane inlet passages 371 act as inlets to the main fuel vane resonators 372 and the main fuel mixing inlets 346 act as outlets to the main fuel vane resonators 372. Due to the geometry of the vanes 345 the main fuel vane resonators 372 may have a tapered shape, such as an ogive or bullet shape.

Referring to FIG. 3, the injector head 330 may also include a main air swirler resonator 344. The main air swirler resonator 344 may be adjacent to the main air inlet 334. The main air swirler resonator 344 may be an in-line resonator that is in-line and within the main premix passage 341. In the embodiment illustrated, the main air inlet passages 342 are inlets to the main air swirler resonator 344 and the spacing between the vanes 345 may form a main air swirler resonator outlet 343. The main air inlet 334 and the vanes 345 may be spaced apart to form the main air swirler resonator 344 there between.

Referring to FIGS. 3 and 5, the injector head 330 may also include a main premix resonator 347. The main premix resonator 347 may be located adjacent to the vanes 345. In some embodiments, the main premix resonator 347 may be downstream of the vanes 345. In other embodiments, the main premix resonator 347 may be upstream of the vanes 345. The main premix resonator 347 may be formed in the injector body 331 and may include a main premix cavity 349 and a main premix neck 348. In the embodiment illustrated, the main premix cavity 349 is an annular cavity located outward from the main premix passage 341. The main premix cavity 349 may extend completely around the main premix passage 341 or may be a sector of an annular cavity extending partly around the main premix passage 341. In the embodiment illustrated, the main premix neck 348 extends from the main premix passage 341 to the main premix cavity 349 and is located adjacent to the vanes 345 and may connect to the main premix passage 341 downstream or upstream of the vanes 345. In some embodiments, the main premix resonator 347 includes multiple main premix necks 348. In these embodiments, the main premix necks 348 may be evenly spaced circumferentially about the injector body 331.

The pilot fuel tubing 317 may include a pilot fuel tubing outlet 338 adjacent to the pilot tube 380. The injector head 330 may also include a pilot premix passage 354, a pilot fuel inlet 353, and a pilot fuel resonator 339. The pilot premix passage 354 may be inward from the main premix passage 341, may be coaxial to the pilot tube 380, and may provide a fuel and air mixture to the combustion chamber 390. The pilot fuel inlet 353 may provide and direct pilot fuel into the pilot premix passage 354 at an end distal to the pilot tube cap 381 and to the pilot tube injection opening 355.

The pilot fuel resonator 339 may be in-line with the pilot fuel inlet 353. The pilot fuel resonator 339 may be adjacent to the pilot fuel tubing outlet 338 and to the pilot fuel inlet 353. In the embodiment illustrated, the pilot fuel resonator 339 includes a circuitous labyrinth passage that delivers pilot fuel from the pilot fuel tubing outlet 338 to the pilot fuel inlet 353, where the pilot fuel tubing outlet 338 acts as an inlet to the pilot fuel resonator 339 and the pilot fuel inlet 353 acts as an outlet to the pilot fuel resonator 339. The circuitous labyrinth passage may be configured to primarily flow in an axial, circumferential, or radial direction. In the embodiment illustrated the circuitous labyrinth includes annular passages connected by radial passages. The annular passages may extend completely around the axis of the injector head 330 or may be annular sectors.

The injector head 330 may also include a pilot air inlet 352, a pilot air resonator 351, and a pilot air resonator inlet 375, which may be formed in the pilot tube 380. The pilot air inlet 352 may be located in the pilot tube 380 adjacent to the pilot fuel inlet 353. The pilot air resonator 351 may be an in-line resonator adjacent to the pilot air inlet 352 and to the secondary air inlet 350. In the embodiment illustrated, the pilot air resonator 351 includes a circuitous labyrinth passage that delivers the pilot air from the secondary air inlet 350 to the pilot premix passage 354. The circuitous labyrinth passage may be configured to primarily flow in an axial, circumferential, or radial direction. In the embodiment illustrated the circuitous labyrinth includes annular passages connected by radial passages. The annular passages may extend completely around the axis of the injector head 330 or may be annular sectors.

The pilot air resonator inlet 375 may direct air into the pilot air resonator 351 from the secondary air inlet 350. In some embodiments, the pilot air resonator inlet 375 may be adjacent to the feed air inlet 333 and may direct air directly from the feed air inlet 333 into the pilot air resonator 351.

Figure 6:
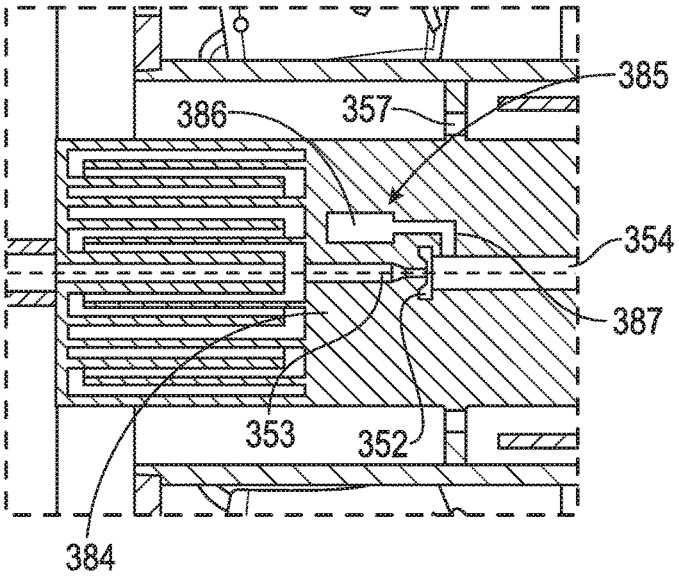
FIG. 6 is a portion of the cross-sectional view of the injector head of FIG. 2. The region of the cross-section is identified by detail box VI in FIG. 3 and is clocked relative to the view in FIG. 3 to show details not visible in FIG. 3.

FIG. 6 is a portion of the cross-sectional view of the injector head 330 of FIG. 2. The region of the cross-section is identified by detail box VI in FIG. 3 and is clocked relative to the view in FIG. 3 to show details not visible in FIG. 3. Referring to FIG. 6, the injector head 330 may include a centerbody 384 and a pilot premix resonator 385. The centerbody 384 may be located within the pilot tube 380 and may be integral to the pilot tube 380. The pilot air inlet 352, the pilot fuel inlet 353, the pilot air resonator 351, the pilot fuel resonator 339, and the pilot premix passage 354 may be formed within the centerbody 384.

The pilot premix resonator 385 may also be located within the centerbody 384 and may be located adjacent to the pilot fuel inlet 353 and the pilot air inlet 352. In the embodiment illustrated, the pilot premix resonator 385 includes a pilot premix cavity 386 and a pilot premix neck 387. The pilot premix neck 387 fluidly connects the pilot premix cavity 386 to the pilot premix passage 354. The pilot premix neck 386 may be located and may fluidly connect to the pilot premix passage 354 adjacent to the pilot fuel inlet 353 and the pilot air inlet 352.

Referring to FIGS. 3 and 5, the injector head 330 may further include a cooling passage 356, cooling passage inlets 358, and multiple cooling passage resonators. The cooling passage 356 may be formed between the inner premix tube 340 and the pilot tube 380. The cooling passage 356 may direct air to impinge onto the inner premix tube cap 379 to cool the inner premix tube cap 379 during operation of the gas turbine engine 100. The cooling passage inlets 357 may direct air into the cooling passage 356 from the secondary air inlet 350. In some embodiments, the cooling passage inlets 357 may direct air directly from the feed air inlet 333 into the cooling passage 356.

In the embodiment illustrated, the injector head 330 includes a first cooling resonator 359, a second cooling resonator 362, and a third cooling resonator 364. The first cooling resonator 359 may include a first cooling resonator cavity 361 and a first cooling resonator neck 360. The first cooling resonator cavity 361 may be outward from the cooling passage 356. The first cooling resonator neck 360 may connect the first cooling resonator cavity 361 adjacent to the cooling passage inlet 357.

The second cooling resonator 362 and the third cooling resonator 364 may be in-line resonators that are at the downstream end of the cooling passage 356 adjacent to the pilot tube cap 381. The injector head 330 may further include first cooling passage holes 358, second cooling passage holes 363, and cooling impingement holes 365. The first cooling passage holes 358 may pass through standoffs 382 to form the inlet to the second cooling resonator 362. The second cooling passage holes 363 may pass through standoffs 382 to form the outlet of the second cooling resonator 362 and the inlet to the third cooling resonator 364. The cooling impingement holes 365 may form the outlet of the third cooling resonator 364 and to the cooling passage 356 to direct the air into the pilot tube cap 381.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 390 and combusted. An air and fuel mixture is supplied via fuel injector 310. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Resonance between the combustor heat release process ("flame") and passages in the fuel injector 310 may result in combustor dynamic pressure oscillations. These passages may include fuel passages, air passages, and fuel/air mixture passages, such as the passages described herein. Fluidly connecting resonators to these passages in the fuel injector 310 may counteract the resonance between unsteady heat release and the passages and may reduce or prevent combustor oscillations.

In particular, connecting the resonators to the passages adjacent to a transition orifice, such as an inlet or an outlet to the passages, within the injector head 330 may place the resonator adjacent to an antinode of a linked resonance between the flame and the passages, which may increase the overall effectiveness of the resonators and further reduce combustor oscillations. Counteracting and reducing combustor oscillations may increase the durability and operating life of the combustor 300 and the various components of the combustor 300.

In some embodiments, the in-line resonators, such as the main fuel stem resonator 323, the pilot fuel resonator 339, and the pilot air resonator 351 may be low pass filters that are configured to filter out vibrations within a low pass frequency range. However, in some embodiments, the resonators are used as band-stop filters, targeting a frequency associated with a mode shape and diminishing it.

The preceding detailed description is merely exemplary in nature and is not intended to limit the invention or the application and uses of the invention. The described embodiments are not limited to use in conjunction with a particular type of gas turbine engine or a particular combustor. Hence, although the present disclosure, for convenience of explanation, depicts and describes particular embodiments of the fuel injector and resonators for a combustor, it will be appreciated that the fuel injector and resonators in accordance with this disclosure can be implemented in various other configurations, can be used with various other types of combustors and gas turbine engines, and can be used in other types of machines. Further, the resonators may be used in conjunction with pilot or main passages for air, fuel, or a mixture thereof and can be used with passages for gas or liquid fuel. Any explanation in connection with one embodiment applies to similar features of other embodiments, and elements of multiple embodiments can be combined to form other embodiments. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A fuel injector for a combustor of a gas turbine engine, the fuel injector comprising:

a stem;

a fitting joined to the stem;

a main stem fuel passage extending within the stem and fluidly connected to the fitting, the main stem fuel passage including a main stem passage outlet; and an injector head adjoining the stem distal to the fitting and adjacent to the main stem passage outlet, the injector head including a feed air inlet that allows compressed air to enter the injector head, a feed air inlet resonator located outward of the feed air inlet, the feed air inlet resonator including a feed air inlet resonator cavity and a feed air inlet resonator neck, the feed air inlet resonator neck being fluidly connected to the feed air inlet resonator cavity and being located adjacent to the feed air inlet, a main premix passage extending through the injector head, a main air inlet for the main premix passage, the main air inlet located adjacent to the feed air inlet, vanes located within the main premix passage for swirling the compressed air that enters the main premix passage through the main air inlet, and a main premix resonator located adjacent to the vanes.

2. The fuel injector of claim 1, wherein the main premix resonator includes a main premix cavity located outward from the main premix passage and a main premix neck that fluidly connects the main premix cavity to the main premix passage.

3. The fuel injector of claim 2, wherein the vanes are axially spaced from the main air inlet forming a main air swirler resonator therebetween that is in-line with the main premix passage, and wherein the main air inlet includes main air inlet passages that are an inlet into the main air swirler resonator and the vanes form a main air swirler resonator outlet.

4. The fuel injector of claim 3, wherein the injector head further includes a main fuel gallery located outward from the main premix passage and fluidly connected to the main stem passage outlet, a main fuel vane resonator located within each of the vanes, a main fuel vane inlet passage for each vane fluidly connecting the main fuel gallery to the main fuel vane resonator, and main fuel mixing inlets that fluidly connect the main fuel vane resonator to the main premix passage.

5. The fuel injector of claim 1, wherein the stem includes a main fuel stem resonator that is in-line with the main fuel stem passage and is adjacent to the main stem passage outlet.

6. The fuel injector of claim 1, wherein the injector head further includes a cooling passage located inward of the main premix passage, a cooling passage inlet that allows compressed air to enter the cooling passage and a cooling resonator adjacent to the cooling inlet.

7. A fuel injector for a combustor of a gas turbine engine, the fuel injector comprising:

a stem;

a fitting joined to the stem;

a pilot stem fuel passage extending within the stem and fluidly connected to the fitting, the pilot stem fuel passage including a pilot stem passage outlet; and an injector head adjoining the stem distal to the fitting, the injector head including a feed air inlet that allows compressed air to enter the injector head, a pilot premix passage for providing a fuel and air mixture to a combustion chamber of the combustor, a pilot fuel inlet for providing the fuel to the pilot premix passage, a pilot fuel resonator adjacent to the pilot fuel inlet, a pilot air inlet adjacent to the pilot fuel inlet, and a pilot premix resonator, the pilot premix resonator including a pilot premix cavity and a pilot premix neck fluidly connecting the pilot premix cavity to the pilot premix passage adjacent to the pilot air inlet and the pilot fuel inlet.

8. The fuel injector of claim 7, wherein the pilot fuel resonator is in-line with the pilot fuel inlet and the pilot premix passage, and wherein the pilot fuel resonator includes a circuitous path.

9. The fuel injector of claim 7, wherein the injector head further includes a pilot air resonator adjacent to the pilot air inlet.

10. The fuel injector of claim 8, wherein the injector head further includes a pilot air resonator adjacent to the pilot air inlet, and wherein the pilot air resonator includes a second circuitous path.

11. The fuel injector of claim 10, wherein the injector head further includes feed air inlet resonators located outward of the feed air inlet, each of the feed air inlet resonators including a feed air inlet resonator cavity and a feed air inlet resonator neck, the feed air inlet resonator neck being fluidly connected to the feed air inlet resonator cavity and being located adjacent to the feed air inlet.

12. The fuel injector of claim 7, wherein the stem includes a pilot fuel stem resonator adjacent to the pilot stem passage outlet.

13. A fuel injector for a combustor of a gas turbine engine, the fuel injector comprising:

a stem;

a fitting joined to the stem;

a main stem fuel passage extending within the stem and fluidly connected to the fitting, the main stem fuel passage including a main stem passage outlet;

a pilot stem fuel passage extending within the stem and fluidly connected to the fitting, the pilot stem fuel passage including a pilot stem passage outlet; and an injector head adjoining the stem distal to the fitting and adjacent to the main stem passage outlet, the injector head including a feed air inlet that allows compressed air to enter the injector head, a main premix passage extending through the injector head, a main air inlet for the main premix passage, the main air inlet located adjacent to the feed air inlet, vanes located within the main premix passage for swirling the compressed air that enters the main premix passage through the main air inlet, a main premix resonator located adjacent to and downstream of the vanes, a pilot premix passage for providing a fuel and air mixture to a combustion chamber of the combustor, a pilot fuel inlet for providing the fuel to the pilot premix passage, and a pilot fuel resonator adjacent to the pilot fuel inlet, wherein the vanes are axially spaced from the main air inlet forming a main air swirler resonator therebetween that is in-line with the main premix passage, and wherein the main air inlet includes main air inlet passages that are an inlet into the main air swirler resonator and the vanes form a main air swirler resonator outlet.

14. The fuel injector of claim 13, wherein the main premix resonator includes a main premix cavity located outward from the main premix passage and a main premix neck that fluidly connects the main premix cavity to the main premix passage, wherein the pilot fuel resonator is in-line with the pilot fuel inlet and the pilot premix passage, and wherein the pilot fuel resonator includes a circuitous path.

15. The fuel injector of claim 13, wherein the injector head further includes a main fuel gallery located outward from the main premix passage and fluidly connected to the main stem passage outlet, a main fuel vane resonator located within each vane, a main fuel vane inlet passage for each vane fluidly connecting the main fuel gallery to the main fuel vane resonator, and main fuel mixing inlets that fluidly connect the main fuel vane resonator to the main premix passage.

16. The fuel injector of claim 13, wherein the injector head further includes a pilot air inlet adjacent to the pilot fuel inlet, and a pilot air resonator adjacent to the pilot air inlet, and wherein the pilot air resonator includes a second circuitous path.

17. The fuel injector of claim 13, wherein the injector head further includes feed air inlet resonators located outward of the feed air inlet, each of the feed air inlet resonators including a feed air inlet resonator cavity and a feed air inlet resonator neck, the feed air inlet resonator neck being fluidly connected to the feed air inlet resonator cavity and being located adjacent to the feed air inlet.

* * * * *